United States Patent [19]

Farr

[11] 4,389,167

[45] Jun. 21, 1983

[54] PUMP HAVING MEMBRANE ACTUATED CONTROL VALVE TO UNLOAD SLAVE ACTUATED INLET VALVE

[75] Inventor: Glyn P. R. Farr, Warwickshire, England

[73] Assignee: Lucas Industries Limited, Birmingham, England

[21] Appl. No.: 204,584

[22] Filed: Nov. 6, 1980

[51] Int. Cl.[3] ..... F04B 49/02; F04B 49/08; F16D 31/02

[52] U.S. Cl. ..... 417/289; 417/295; 417/298; 60/413; 60/418

[58] Field of Search ..... 417/289, 295, 298, 307; 60/418, 413

[56] References Cited

U.S. PATENT DOCUMENTS

| | | | |
|---|---|---|---|
| 1,988,296 | 1/1935 | Blume et al. | 417/295 X |
| 2,661,893 | 12/1953 | Le Valley | 417/295 X |
| 2,867,091 | 1/1959 | Orloff et al. | 417/289 X |

FOREIGN PATENT DOCUMENTS 2003555 3/1979 United Kingdom .

*Primary Examiner*—Richard E. Gluck
*Attorney, Agent, or Firm*—Scrivener, Clark, Scrivener and Johnson

[57] ABSTRACT

In an hydraulic system an unloader valve is disposed in a supply line between a pump and an hydraulic accumulator. The unloader valve is operative to prevent the accumulator from being overcharged and to allow the pump to re-charge the accumulator should the pressure stored therein fall below a desired minimum value. The unloader valve incorporates a control valve comprising a spool and a pressure responsive slave which is operated by fluid pressure under the control of the control valve. The spool is movable between a first position in which the accumulator is isolated from the slave so that pump pressure is supplied to the accumulator and acts through a membrane on a trapped volume of gas under pressure, and a second position in which fluid pressure from the accumulator acts on the slave to unload the pump. The membrane of the accumulator acts directly on the spool to control movement of the spool between the two positions. In an alternative embodiment, the membrane acts indirectly on the spool through an operating rod and an operating member.

9 Claims, 2 Drawing Figures

PUMP HAVING MEMBRANE ACTUATED CONTROL VALVE TO UNLOAD SLAVE ACTUATED INLET VALVE

SPECIFIC DESCRIPTION

Figure 1:
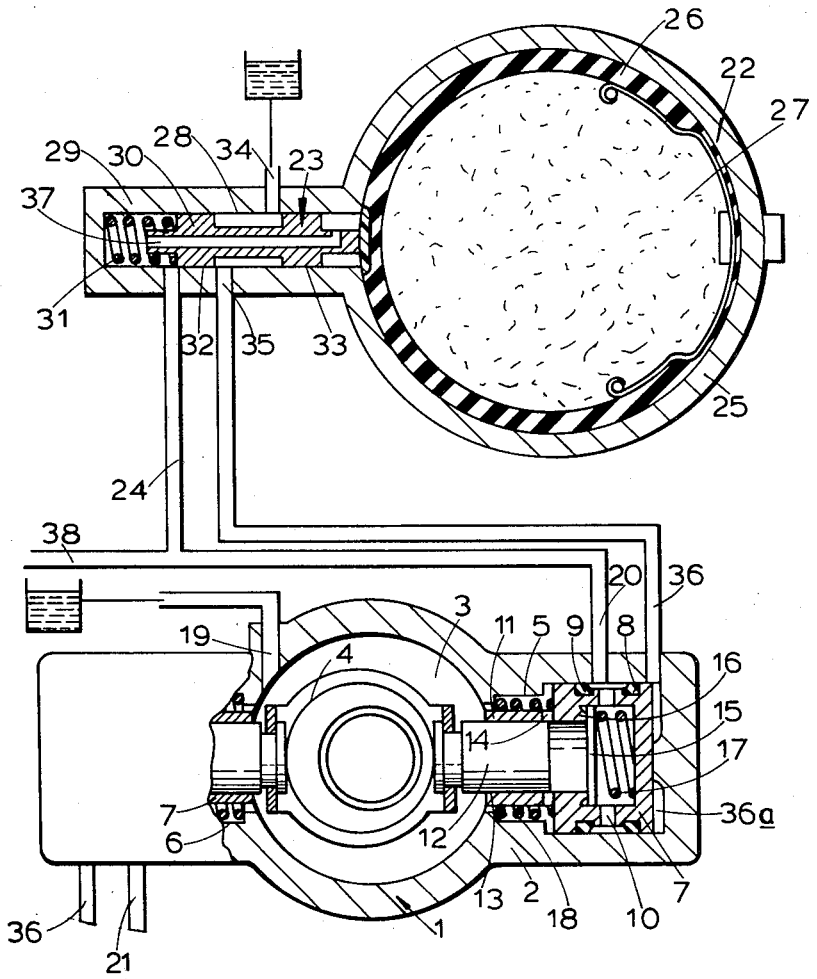

This invention relates to improvements in hydraulic systems of the kind in which an hydrualic accumulator is charged with hydraulic fluid under pressure by means of an hydraulic pump which draws hydraulic fluid from a tank, and an unloader valve disposed in a supply line between the pump and the accumulator is operative to prevent the accumulator from being overcharged and to allow the pump to re-charge the accumulator should the pressure stored therein fall below a desired minimum value, the unloader valve incorporating a control valve, and a pressure responsive slave which is operated by fluid pressure under the control of the control valve is provided, the control valve comprising a valve member which is movable between a first position in which the accumulator is isolated from the slave so that pump pressure is supplied to the accumulator and acts through a membrane on a trapped volume of gas under pressure, and a second position in which fluid pressure from the accumulator can act on the slave to render the slave operative to unload the pump.

The Specification of U.S. Patent Application Ser. No. 937,706, now U.S. Pat. No. 4,199,941, discloses an hydraulic system of the kind set forth in which the accumulator is only in fluid communication with the unloader valve. In the specific construction disclosed in the said Specification two springs bias the valve member into the first position, and the second spring is inoperative when the valve member is moved into the second position in response to pressure in the accumulator which acts directly on the valve member and which determines a "cut-out" point at which the valve member can move into the second position, the bias in the first spring alone determining a "cut-in" point at which the valve member can be returned to the first position.

According to our invention in an hydraulic system of the kind set forth the membrane of the hydraulic accumulator itself co-operates with the valve member to provide a force for controlling movement of the valve member between the two positions.

This facilitates the construction and makes an assembly of the unloader valve and the accumulator more compact.

The membrane can act directly on the valve member. Alternatively the membrane can act on the valve member indirectly through an intermediate member.

When the membrane acts directly on the valve member it can hold the valve member in the first position against the force in a spring tending to urge the valve member towards the second position and, as the accumulator is charged, the fluid introduced into the accumulator moves the membrane against the gas pressure until, at a "cut-out" point, sufficient volume has been introduced to allow the valve member to move into the second position under the influence of the spring.

In a modified construction the membrane acts on a valve operating member normally to hold it in an inoperative position against the loading in an operating spring, and a return spring acts on the valve member normally to hold it in the first position. When the accumulator is charged the membrane moves against the gas pressure thus permitting the operating spring to act on the valve member through the operating member and move the valve member into the second position at a "cut-out" point.

In our invention a "cut-in" point at which the valve member can return to its first position is determined by a predetermined position of the membrane when a predetermined "cut-in" fluid pressure is present in the accumulator.

Figure 2:
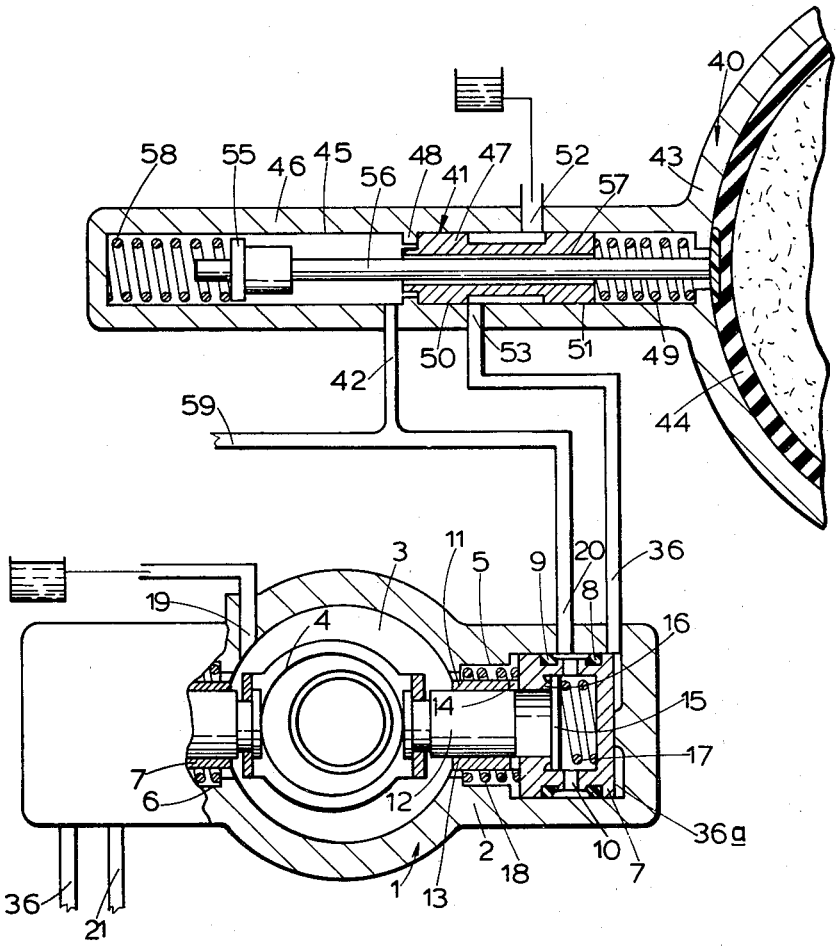

Two embodiments of our invention are illustrated in the accompanying drawings, in which:

FIG. 1 is a section through an hydraulic pump in combination with an unloader valve; and FIG. 2 is a section through the same hydraulic pump in combination with a modified unloader valve.

In an hydraulic system illustrated in FIG. 1 of the drawings, an hydraulic pump 1 comprises a housing 2 incorporating a circular pump chamber 3, in which an eccentric drive 4 is housed, and diametrically opposed stepped blind bores 5, 6, which are in open communication at their inner ends with the chamber 3.

A slave comprising a sleeve 7 is slidably mounted in the portion of each bore 5, 6 which is of greater diameter, and sealing rings 8, 9 carried by the sleeve 7 are disposed in grooves spaced axially from diametral ports 10 in the sleeve 7. The sleeve 7 includes an extension 11 of reduced diameter which extends towards the pump chamber 3 and a pump plunger 12 is adapted to be reciprocated in an internal bore 13 in the extension 11 by the drive 4. Inlet ports 14 are disposed in the wall of the sleeve 7, and a one-way valve member 15 is normally urged into engagement with a seating 16 positioned between the ports 14 and 10 by means of a spring 17. A compression spring 18 normally urges the sleeve 7 at its outer closed end into engagement with the closed outer end of its respective bore 5, 6. The drive 4 is coupled to both plungers 12 so that movement of one plunger 12 in one direction is accompanied by movement of the other plunger in the opposite direction.

The housing 2 is provided with a port 19 by means of which the pump chamber 3 is connected to a reservoir for hydraulic fluid, and the housing 2 is also provided with outlet ports 20, 21 in permanent communication with the ports 10.

When the eccentric drive 4 is operated to cause reciprocation of both pump plungers 12 in the bores 13, normally, with the sleeves 7 in the positions shown, fluid is drawn by each plunger 12 into its bore 13 through the inlet ports 14 from whence it is pumped to the respective outlet port 20, 21 past the valve member 15 and through the ports 10.

Each of the outlet ports 20, 21 is connected to an hydraulic accumulator 22 through an unloader valve 23 and a pipe-line 24 leading to the unloader valve 23. As illustrated the accumulator 22 comprises a container 25 incorporating a membrane 26 which separates a volume 27 of gas under pressure from hydraulic fluid in a blind bore 28 in a valve housing 29 which is carried from, or integral with, the container 25.

A valve spool 30 works in the bore 28 and at its inner end is at all times urged into engagement with the membrane 26 by means of a compression spring 31 which acts between the spool 30 and the closed outer end of the housing 29. The valve spool 30 is provided with spaced lands 32, 33 which in the position shown, are disposed on opposite sides of an port 34 for connection to the same or a different reservoir for fluid and port 35 for connection through a pipe-line 36 to a chamber **36*a* of the pump 1**, defined between the adjacent closed ends of the bore 5 and the sleeve 7. The spool 30 is provided with a longitudinal passage 37 which provides communication at all times between portions of the spool 30 outwardly of the lands 32, 33.

In the position shown in the drawing in which the accumulator contains no fluid the pump plunger 12 pumps fluid from the port 20 and into the accumulator 22 through the pipe-line 24 and the bore 37. In addition fluid can be pumped to services, for example a vehicle suspension strut or struts, through a branch line 38 leading from the line 24. In this position the spool 30 is in the first position to place the pipe-line 36 in communication with the reservoir, and so isolate the accumulator 22 from the sleeve 7.

Whilst the accumulator charges to a predetermined first value, equal to the pressure at a "cut-in" point of say 2000 p.s.i., the membrane 26 moves towards the right against the pressure of the trapped volume 27 of gas. Due to the force in the spring 31 the spool 30 follows this movement of the membrane and closes the outlet port 35 to isolate the chamber 36*a* from the reservoir.

At a "cut-out" point at say 2500 p.s.i., the membrane 26 has moved sufficiently for the land 32 to have passed over the outlet port 35 with the result that the spool is in the second position with the port 35 being placed in communication with the accumulator 22 through the passage 37. The accumulator fluid pressure then acts, through the pipe-line 36, on the pressure responsive face of sleeve 7 and the sleeve 7 moves inwardly against the loading in the spring 18 until the inlet ports 14 are closed by the pump plunger 12, irrespective of its position in the bore 13. This means that the pump plunger 12 idles and no fluid can be pumped through the pipe-line 24.

As the fluid pressure stored in the accumulator 22 is used the membrane 26 and the spool 30 move in the opposite direction until at an accumulator fluid pressure of 2000 p.s.i. the valve spool 30 has returned to the first position with the land 32 having moved through a sufficient distance for the pressure responsive face of sleeve 7 to be reconnected to the reservoir. The spring 18 then urges the sleeve 7 axially and into its initial position with the inlet ports 14 being re-opened so that the pump 1 is again operative to re-charge the accumulator 22.

In the hydraulic system illustrated in FIG. 2 of the accompanying drawings, the hydraulic pump 1 is of the same construction as that described above with reference to FIG. 1. Each of the outlet ports 20, 21 is connected to an hydraulic accumulator 40 through a modified unloader valve 41 and a pipe-line 42. Again the accumulator 40 comprises a container 43 incorporating a membrane 44 which separates a volume of gas under pressure from hydraulic fluid in a blind bore 45 of a valve housing 46 which is carried from, or is integral with, the container 43.

A valve spool 47 works in the bore 45 and is urged in a direction away from the membrane 44 and against a stop 48 in the bore 45 by means of a spring 49. In this position spaced lands 50, 51 are disposed on opposite sides of an port 52 for connection to the same or a different reservoir for fluid and port 53 for connection through the pipe-line 36 to the chamber 36*a* defined between the adjacent closed ends of the bore 5 and the pressure responsive face of sleeve 7 which works in that bore 5.

A valve operating member 55 is carried by the free outer end of an operating rod 56. The operating rod 56 projects through a longitudinally extending clearance bore 57 in the valve spool 47 and at its free inner end is urged into engagement with the membrane 44 by means of an operating spring 58.

The accumulator 40 is to be used to power a brake servo through a branch line 59 from the pipe-line 42. Thus accumulator 40 has a pre-charged fluid pressure of, say 500 p.s.i. The spool 47 is arranged such that the membrane 44 can move without disturbing the spool 47 until the desired pressure of the cut-in point is attained. This is achieved by the provision of the operating rod 56 which prevents the operating member 55 from engaging with the valve spool 47 until the accumulator 40 has been charged to a pressure equal to the pressure at the cut-in point of say 2000 p.s.i. Thereafter the movement of the spool 47 to determine the cut-out and the cut-in points are the same as those described above with reference to the embodiment of the accumulator 22 and the unloader valve 23.

In each construction a relief valve is fitted between the accumulator 22, 40 and the reservoir to prevent over pressurisation of the accumulator due to expansion of gas or air at high temperature.

We claim:

1. An hydraulic system comprising an hydraulic pump having an inlet for connection to a tank for fluid, an hydraulic accumulator, a supply-line between said pump and said accumulator, and an unloader valve disposed in said supply line to limit the pressure which can be stored in said accumulator, said unloader valve incorporating a control valve, and a pressure-respondive slave operated by fluid pressure under control of said control valve, said pressure-responsive slave having a pressure-responsive face and being provided with means defining a flow-path between said pump and said accumulator, said control valve comprising a valve member movable between a first position in which said accumulator is isolated from said pressure-responsive face of said slave, and a second position in which fluid pressure from said accumulator acts on said pressure-responsive face of said slave to render said slave operative to unload said pump, and said accumulator incorporating a container, and a membrane in said container to trap a volume of gas under pressure in said container and separate said gas from fluid from said pump, said membrane itself also co-operating with said valve member to provide a force for controlling movement of said valve member between said first and second positions in accordance with said pressure in said accumulator.

2. An hydraulic system as claimed in claim 1, wherein a spring is provided to urge said valve member towards said second position, and said membrane acts directly on said valve member and is adapted normally to hold said valve member in said first position against the force in said spring and to move said valve member into said second position only when said accumulator has been charged to a predetermined "cut-out" pressure.

3. An hydraulic system as claimed in claim 1, wherein said unloader valve also incorporates a valve operating member, an operating spring and a return spring, said membrane acting on said valve operating member normally to hold said valve operating member in an inoperative position against the loading in said operating spring, said return spring acting on said valve member normally to hold said valve member in said first position, and said membrane being adapted to act on said valve member indirectly through said operating member to move said valve member into said second position only when said accumulator has been charged to a predetermined "cut-out" pressure.

4. An hydraulic system as claimed in claim 3, wherein said operating spring acts on said valve member through said operating member only when the pressure in said accumulator is at a value equal to, or greater than a predetermined "cut-in" pressure.

5. An hydraulic system as claimed in claim 1, wherein said valve member comprises a valve spool which works in a bore, and said spool is provided with axially spaced lands which control communication between said pump, said slave and said accumulator, and between a reservoir and said slave.

6. An hydraulic system as claimed in claim 5, wherein said spool is provided with a longitudinal passage which provides communication at all times between portions of said spool outwardly of said lands.

7. An hydraulic system as claimed in claim 4, wherein said valve operating member is carried by the outer end of an operating rod, and said valve member comprises a valve spool having a longitudinal passage through which said operating rod projects, said operating rod being urged into engagement with said membrane by said operating spring.

8. An hydraulic system as claimed in claim 1, wherein the slave comprises a piston which acts to disable said pump.

9. An hydraulic system as claimed in claim 8, wherein said slave comprises a sleeve which is slidably mounted in a bore and acts against a return spring to disable said pump when said control valve is in said second position.

* * * * *